US005308671A

United States Patent [19]

Wells

[11] Patent Number: 5,308,671

[45] Date of Patent: May 3, 1994

[54] DECORATION SYSTEM

[75] Inventor: Sandra L. Wells, Laguna Hills, Calif.

[73] Assignee: Sanjam Originals, Inc., Laguna Hills, Calif.

[21] Appl. No.: 886,746

[22] Filed: May 21, 1992

[51] Int. Cl.[5] ..... A44B 17/00; B32B 3/06

[52] U.S. Cl. ..... 428/99; 2/245; 2/300; 2/425; 24/693; 24/90 HA; 24/620; 24/680; 24/681; 24/690; 24/691; 428/4; 428/5; 428/52

[58] Field of Search ..... 428/99, 4, 5, 52, 542.2; 2/245, 425, 300; 24/693, 691, 690, 681, 680, 620, 621, 304, 90 HA

[56] References Cited

U.S. PATENT DOCUMENTS 3,596,291 8/1971 Thill ..... 2/245
4,106,126 8/1978 Trankle ..... 428/4
4,847,917 7/1989 Strongwater ..... 428/4
5,004,144 4/1991 Selga ..... 428/4
5,038,413 8/1991 Ursino ..... 2/239

*Primary Examiner*—Ellis P. Robinson
*Assistant Examiner*—Nasser Ahmad
*Attorney, Agent, or Firm*—Knobbe, Martens, Olson & Bear

[57] ABSTRACT

A detachable decoration system including a first releasably interlockable fastener permanently connected to an article to be decorated and second releasably interlockable fastener permanently connected to a decoration adapted to selectively interlock with the first fastener. Once the interlockable fasteners are disengaged, the decoration is wholly disconnected from the article, thus permitting the article to be washed without damaging the decoration.

3 Claims, 4 Drawing Sheets 3
3
9
11
11
13
13
15
15
17
19
21
23
25
27
29
31
33
35
37
39
41
43
45
47
49
51
59
61
73

FIG. 2a
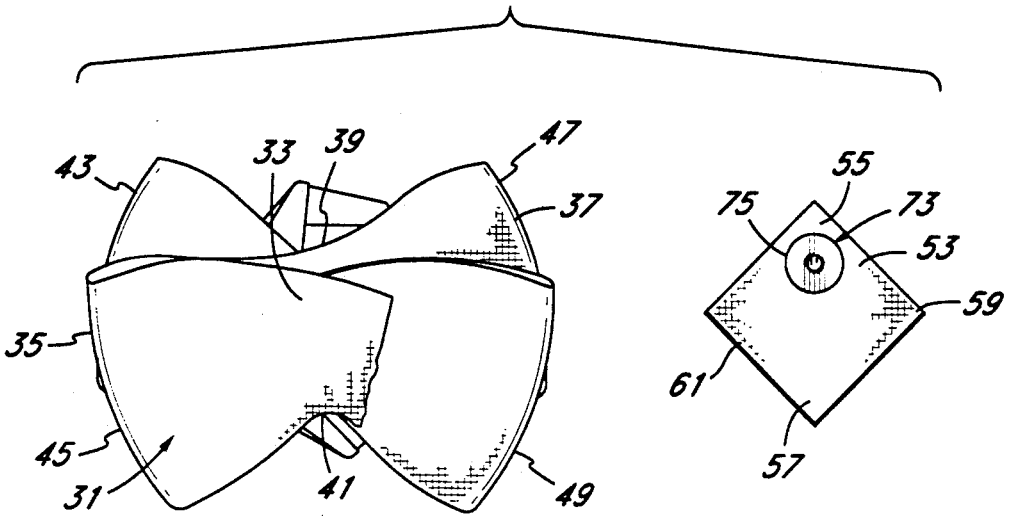
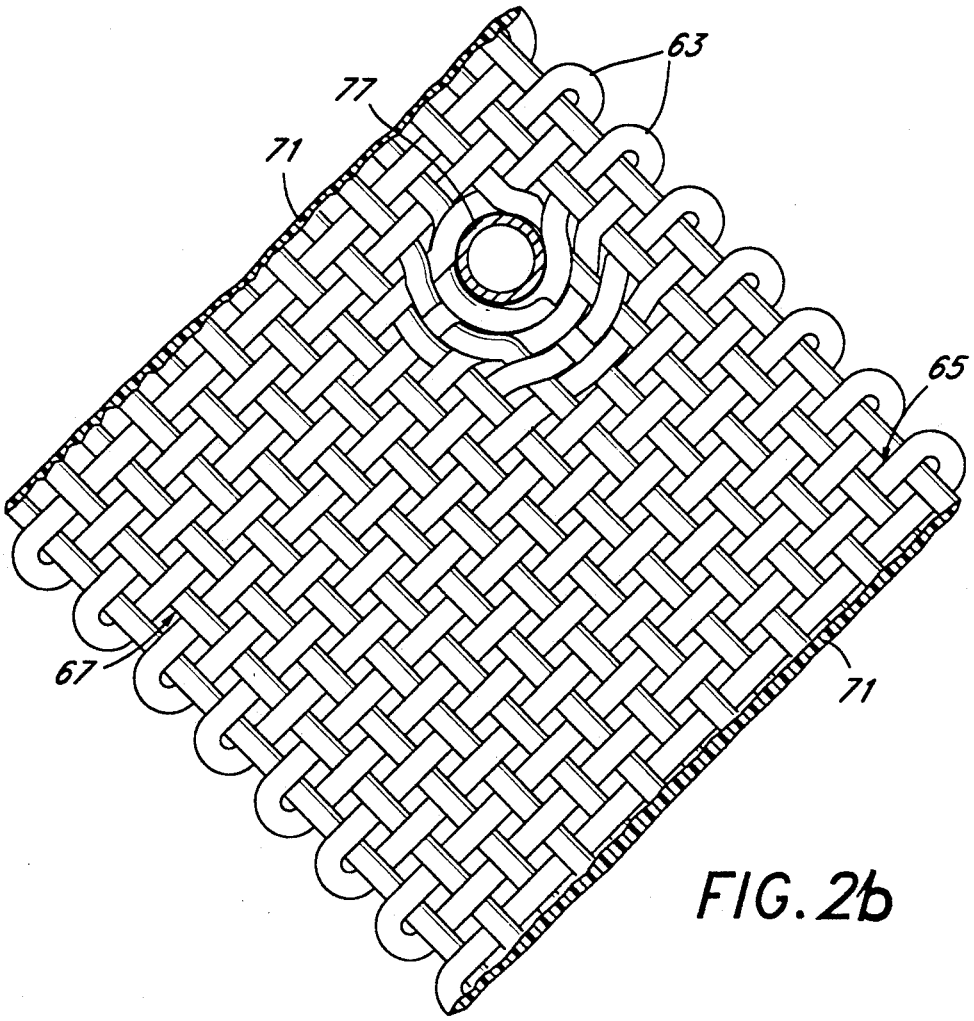
FIG. 2b

DECORATION SYSTEM

FIELD OF THE INVENTION

This invention relates to decoration systems and, in particular, to decoration systems for clothing.

BACKGROUND OF THE INVENTION

It is popular for young children to wear socks decorated with bows. The bows are securely sewn to the knit socks with thread, and are usually of a contrasting color with the sock, so as to stand out.

Despite the popularity of decorated socks with children, however, these socks are often worn only on special occasions. This is because after only relatively few washings, the bows are usually damaged or faded.

Efforts have been made to overcome this problem by improving the quality of the dies and material used in making the bows. While socks with higher quality bows are better able to withstand the washing process, they tend to be relatively expensive and, over time, are also damaged by the washing process.

Often the decorated socks will not be of a color which matches the outfit which the child is to wear. As a result, the child is either unhappy that it is unable to wear its decorated socks or a set of decorated socks must be purchased to go with the child's outfit.

Thus, the need remains for an improved decorated sock.

SUMMARY OF THE INVENTION

The detachable decoration system of the present invention satisfies the need of the prior art by providing a first releasably interlockable fastener permanently connected to an article to be decorated and a second releasably interlockable fastener permanently connected to a decoration adapted to selectively interlock with the first fastener. Once the interlockable fasteners are disengaged, the decoration is wholly disconnected from the article, thus permitting the article to be washed without damaging the decoration.

An important aspect of the invention is that the permanent attachment of the first interlockable fastener to the article makes it unnecessary for the user to determine the aesthetically pleasing location of the decoration on the article. In its preferred embodiment, the first releasably interlockable fastener is a first portion of a snap and the second releasably interlockable fastener is a second portion of a snap. In the case of decorated socks, the permanent attachment of the female portion of the snap to the sock makes it easy for a child to dress themselves, as there is no need to realign the position of the bow on the sock. Importantly, the snap has no sharp edges, such as a pin, and is easy for even a small child to manipulate, in contrast to buttons. Furthermore, the snap is desirable in that it will not attach itself to other pieces of clothing during the wash cycle, and is relatively inexpensive.

Another aspect of the invention is that the second releasably interlockable fastener is connected to the decoration above the center of gravity of the decoration. Importantly, this prevents the top of the decoration from tipping outward from the force of gravity on the decoration when being worn. In addition to improving the appearance of the decorated sock, this also avoids the creation of a moment force at the juncture of the interlocking portions of the fasteners which could lead to accidental releasement of the decoration.

Another aspect of the invention is a detachable decoration system wherein a first releasably interlockable fastener is permanently connected to an article to be decorated and a second releasably interlockable fastener is permanently connected to a base. The decoration includes a decorative bow having a front face, a back face, a central intersecting portion, a first wing portion extending to one side of the central portion, and a second wing portion extending to the opposite side. The base includes a connecting surface and a facing surface. A layer of adhesive secures the connecting surface to the second releasably interlockable fastener such that the upper portion of the base extends substantially to the top of the central portion of the bow, the lower portion of the base extends substantially to the bottom of the central portion of the bow, the first side portion of the base extends along the first wing portion of the bow, and the second side portion extends along the second wing portion. Thus, the base and the adhesive provide structural support for the decoration. Not only does the structural support help maintain the pleasing appearance of the bow, but the base keeps the bow from folding backward over the second fastener, thereby interfering with the attachment of the decoration to the article.

Since the second releasably interlockable fastener is directly connected to the base, the repeated stress of locking and unlocking the respective fasteners is borne by the base, rather than the decoration. This not only lengthens the life of the decoration, but permits greater flexibility in choosing the type of material from which the decoration is constructed.

Another aspect of the invention is a detachable decoration system including a first releasably interlockable fastener permanently connected to an article to be decorated, a decoration, a base, a back nipple, a front nipple and a layer of adhesive. The base defines a facing surface and a connecting surface, and is formed of strands of fibers woven such that the connecting surface of the base is uneven. The inner protuberance of the back nipple extends through the base between the strands of fibers such that the backing member is positioned against the connecting surface of the base. Desirably, the front nipple is positioned above the center of gravity of the decoration secured to the base. The uneven surface of the connecting surface of the base provides increased surface area for adhesion. The outer protuberance of the front nipple defines an internal cavity within which the back nipple is tightly secured so as to permanently affix the front nipple against the facing surface of the base and the back nipple against the connecting surface of the base. The outer protuberance of the front nipple of the base can be releasably lockably retained within the opening of the receiving element so that the back face of the decoration is facing the outer surface of the article and the front face of the decoration is facing away from the outer surface of the article.

Yet another aspect of the invention is a method of providing a detachable decoration on an article, including the steps of permanently affixing a first releasably interlockable fastener to the article; permanently affixing a second releasably interlockable fastener adapted to interlock with the first fastener to a decoration which is wholly disconnected from the article; and bringing the first fastener into contact with the second fastener so that the fasteners interlock.

Yet another aspect of the invention is an interchangeable decoration system. The system includes a plurality of articles to be decorated, a plurality of first releasably interlockable fasteners, at least one of which is permanently connected to each of said plurality of articles to be decorated, a decoration and a second releasably interlockable fastener permanently connected to the decoration. The second releasably interlockable fastener is adapted to selectably interlock with any of a plurality of first releasably interlockable fasteners. When one of the plurality of first interlockable fasteners and the second interlockable fastener are unlocked, the article to which the one of the plurality of first releasably interlockable fasteners is permanently connected is wholly disconnected from the decoration. Desirably, the interlockable fasteners comprise portions of a snap. When the articles to be decorated are wearing apparel, such as socks, the user is able to utilize a single decoration with multiple articles, allowing the decoration to be worn while some of the articles are being washed.

Another aspect of the invention is an interchangeable decoration system including an article to be decorated, a first releasably interlockable fastener permanently connected to the article, a plurality of decorations and a plurality of second releasably interlockable fasteners, at least one of which is permanently connected to each of the plurality of decorations. When the first interlockable fastener and any of the second interlockable fasteners are unlocked, the decoration to which the second interlockable fastener is permanently connected is wholly disconnected from the article. The system permits a child to use a variety of decorations with a single article, such as a sock or a headband to provide a different visual appearance.

BRIEF DESCRIPTION OF THE DRAWINGS

FIG. 2*a* is an exploded perspective view of the decoration of FIG. 2.

FIG. 2*b* is an enlarged partial sectional view of the base of the decoration of FIG. 2*a*.

DETAILED DESCRIPTION OF THE PREFERRED EMBODIMENT

Figures 1, 2:
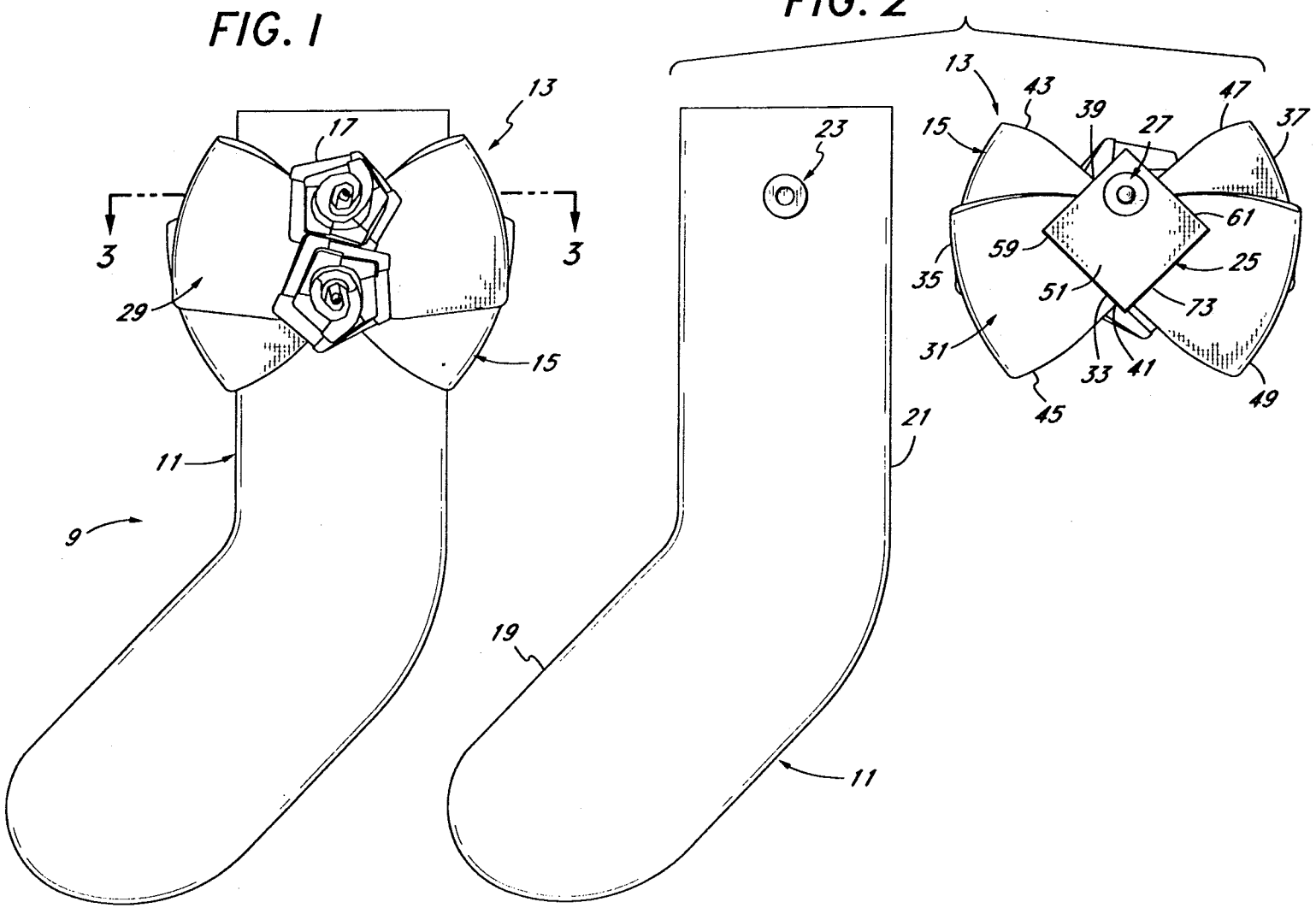
FIG. 1 is a perspective view of a decorated sock in accordance with the principles of the present invention.
FIG. 2 is a perspective view of the sock and decoration of the decorated sock of FIG. 1.

FIG. 1 illustrates a decorated sock 9 which is a preferred embodiment of the decoration system of the present invention. The decorated sock 9 includes a sock 11 and a decoration 13. The decoration 13 includes a bow 15 and an ornament, such as flowers 17. Referring to FIG. 2, the sock has a angled foot portion 19 and an upright leg portion 21. A first releasably interlockable fastener, such as the female portion of a snap 23, is attached to the upright leg portion of the sock. A rectangular base 25 is secured to the decoration 13 to which is secured a second releasably interlockable fastener, such as the male portion of a snap 27. It will be appreciated that this permits the decoration 13 to be snapped onto the upright leg portion 21 of the sock 11 to provide a pleasing appearance while the sock is being worn, and permits the decoration 13 to be removed from the sock 11 so that the sock 11 can be washed without damaging the decoration 13. Likewise, it will be appreciated that the decoration could be secured to other types of wearing apparel, such as shirts, head bands and other accessories.

An important aspect of the invention is the manner in which the system is constructed. Referring to FIGS. 1, 2, 2*a*–*b* and 3, the bow 15 has a front face 29 and a back face 31. The bow 15 is preferably formed from a single length of ribbon folded to form a central intersecting portion 33, a first wing portion 35 extending to a side of the central portion, and a second wing portion 37 extending to an opposing side of the central portion 33 from the first wing portion 35. The central intersecting portion 33 has a top 39 and a bottom 41. The first wing portion 35 is formed by an upper loop 43 and a lower loop 45. Likewise, the second wing portion 37 is formed by an upper loop 47 and a lower loop 49. Desirably, the type of ribbon used to make the bow is a 100% flame retarded polyster.

Figure 3:
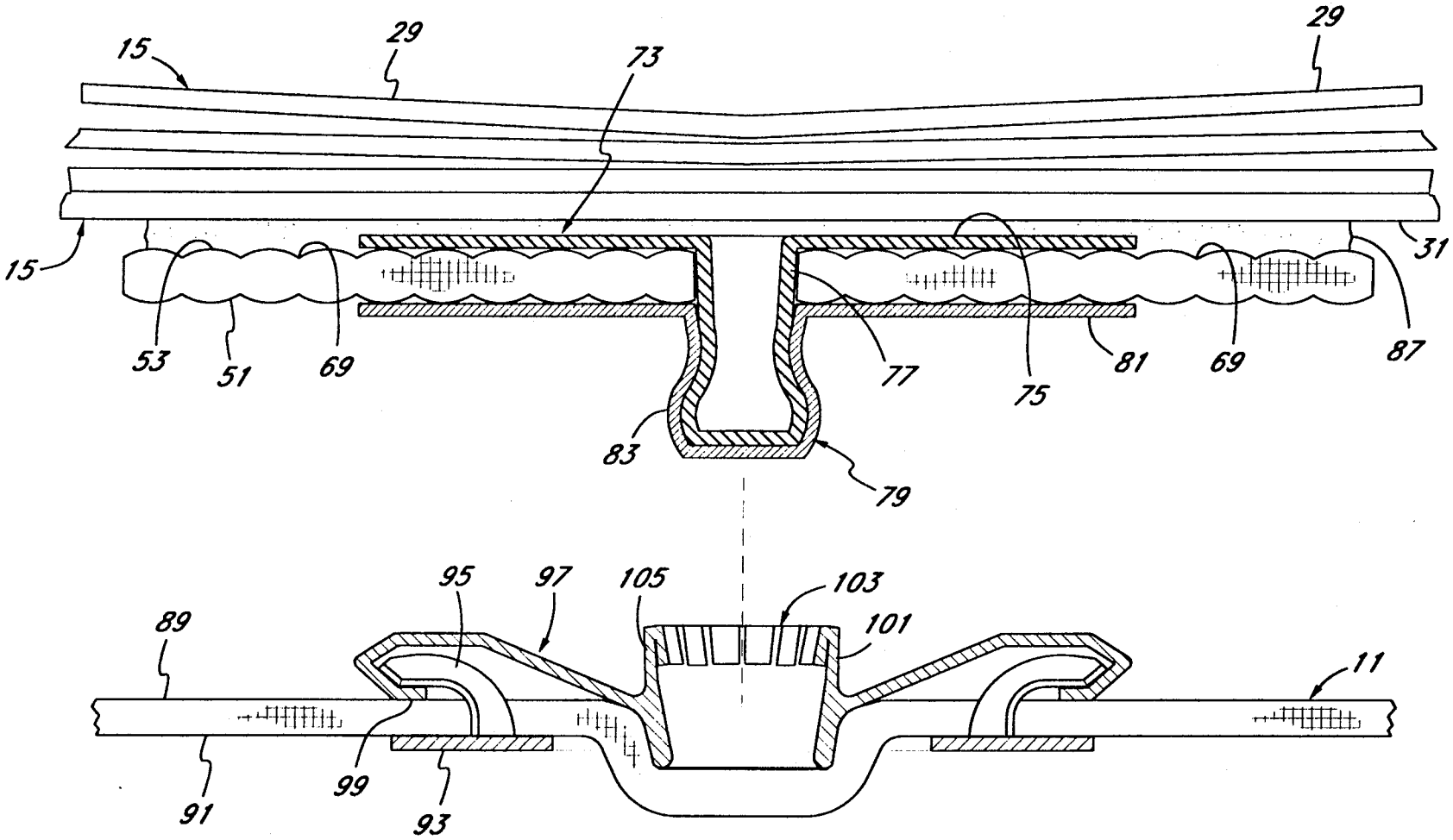
FIG. 3 is a side cross-sectional view illustrating the components of the decorated sock of FIG. 1.

The base 25 includes a planar facing surface 51, a planar connecting surface 53, an upper portion 55, a lower portion 57, a first side portion 59 and a second side portion 61. An important aspect of the invention is that the base is formed by a plurality of strands of fibers 63 woven into a series of rows 65 and columns 67. The fibers used are relatively large so that the front and back surfaces 51 and 53 are uneven, forming a series of small recesses 69 (FIG. 3). Preferably, the base is a piece of poly-propylene webbing formed with strands having a diameter of 0.059 millimeter and a five-hundred pound breaking strength. The webbing is preferably formed from long strips with interlocking stitches on the sides and is cut into rectangular pieces by a heat cutting machine which forms a continuous melted edge 71 at the ends which resists fraying.

A back nipple 73 having an annular backing disk 75 and a central axially extending inner protuberance 77 extends through the upper portion of the base 25 between the strands of fibers such that the backing disk 75 is positioned against the connecting surface 53 of the base. A front nipple 79 having an annular front disk 81 and a central axially extending outer protuberance 83 is positioned opposite the back nipple 73, and is held in place thereby. Specifically, the outer protuberance 83 defines an internal cavity 85 into which the inner protuberance of the back nipple is press fit so as to permanently affix the front disk 81 against the facing surface 51 of the base and to permanently affix the backing disk 75 against the connecting surface 53 of the base. The outer protuberance 83 has an enlarged outer end having a larger circumference than the length of the outer protuberance.

A layer of quick-drying adhesive 87, such as a thick hot melting adhesive used in a hot glue dispenser, secures the base and the male portion of the snap 27 secured to the base 25 to the decoration 13. Importantly, the layer of adhesive is pressed into the recesses 69 of the connecting surface 53 of the base and the uneven connecting surface 53 provides increased surface area for the adhesive bond. Also, importantly, the base 25 and the layer of adhesive 87, when dry, are relatively stiff, yet are sufficiently flexible that the base will not break when subjected to impact.

Although it would be possible to connect the male portion of a snap 27 directly to the decoration 13, the base 25 performs several important purposes. The relatively stiff base 25 and adhesive 87 are positioned to provide structural support for the bow. Specifically, the upper portion 55 of the base extends to the top 39 of the intersecting portion 33 of the bow 15, the lower portion 57 of the base 25 extends to the bottom 41 of the central portion 33 of the bow 15, the first side portion 59 of the base 25 extends along the first wing portion 35 of the bow 15, and the second side portion 61 extends along the second wing portion 37 of the bow 15. Additionally, the base 25 is constructed in such a manner that it is better suited to withstand the repeated stress exerted when the male and female portions of the snap 27 and 23 are unsnapped, than the bow 15. This not only lengthens the life of the bow 15, but it permits greater flexibility in choosing the type of material from which the bow 15 is constructed.

The sock 11 defines a outer surface 89 and a inner surface 91. An annular backing ring 93, including a plurality of axially extending prongs 95, is positioned against the inner surface 91 of the sock 11 so that the prongs 95 extend through the sock 11. An annular receiving ring 97 is positioned against the outer surface 91 of the sock 11 and includes an inwardly extending annular flange along its outer circumference. The prongs 95 of the backing ring 93 extend radially outward under the annular flange 99 of the annular retaining ring so as to permanently affix the backing ring 93 against the inner surface 91 of the sock 11, and the receiving ring 97 against the outer surface 89 of the sock 11. The annular receiving ring is further provided with an axially extending annular gripping projection 101, defining a central generally cylindrical opening 103 which is wider distal the mouth of the opening than proximate thereto. The annular gripping projection 101 is formed by a series of eight axially extending flanges 105.

Figure 4:
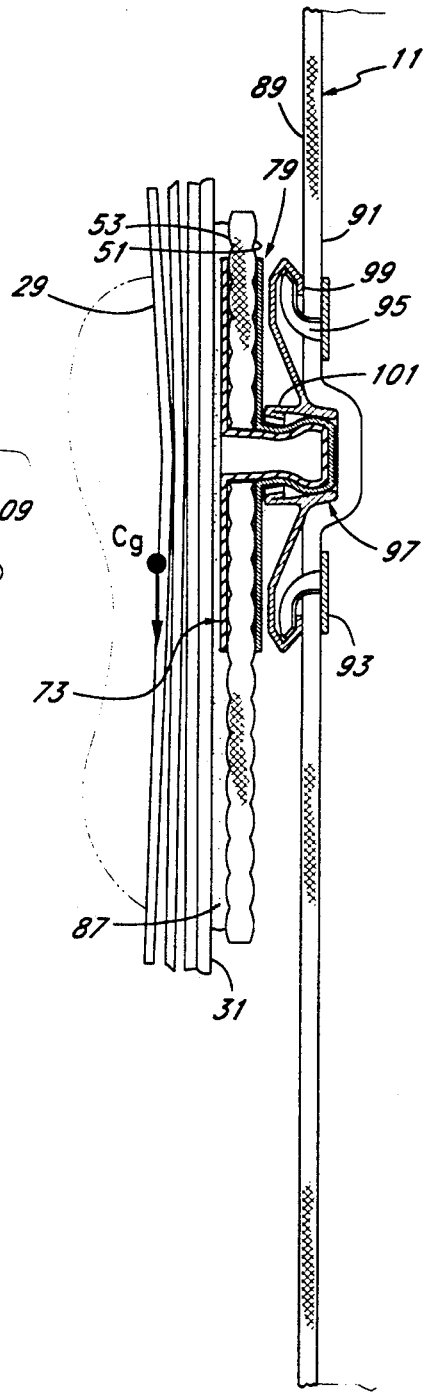
FIG. 4 is a side cross-sectional view of the decorated sock of FIG. 1 on the leg of a wearer.

Referring to FIG. 4, as will be appreciated, when the outer protuberance 83 of the front nipple 79 is inserted into the opening 103, the enlarged distal end of the protuberance causes the axially extending flanges 105 of the annular gripping projection 101 to momentarily flex outward allowing the outer protuberance into the opening 103. Once the enlarged distal end of the outer protuberance 83 has passed through the mouth of the opening 103, the flanges 105 spring radially inward locking the outer protuberance of the male portion of the snap into the opening in the female portion of the snap. Desirably, the interlocking portions of the snap provide a relatively high resistance to a releasing force before separating, so that the snap does not inadvertently come open during use. The mating portions of the snap are desirably nickle-coated brass and, preferably, are of a fifteen line type, such as Model Nos. BC316-3RBNI and BD316-4RBNI distributed by B & B Fasteners of Carson, Calif.

The decoration has a center of gravity $C_g$. An important aspect of the invention is that the male portion of the snap 27 is positioned above the center of gravity $C_g$ of the decoration 13 to prevent the top of the decoration from tipping outward from the force of gravity on the decoration when worn. In addition to improving the appearance of the decorated sock when worn, this also avoids the creation of a moment force at the juncture of the interlocking portions of the snap which could lead to accidental releasement of the decoration when worn.

The described system permits decorations to be removed from a sock or other article of clothing such as a head band quickly and easily, so that the piece of clothing may be washed without destroying or discoloring the decoration. Furthermore, it will be appreciated that the present system provides for a much greater variety of decorations, as all previous decorations had to be washable. An important aspect of the foregoing system is that the base is formed so that it can be secured to the bow in a manner such that it will not pull off after repeated use. Likewise, another important aspect of the invention is the use of a woven base which permits the back nipple 73 to be inserted through the base without diminishing the structural integrity of the base. Further, the sandwiching of the base between the annular backing disk 75 of the back nipple 73 and the front disk 81 of the front nipple 79 prevents the snap from being separated from the base.

As discussed above, the base 25 and the layer of adhesive 87 provide structural support for the bow 15, keeping the bow from interfering with the interlocking portion of the snaps and maintaining the desired appearance of the bow. At the same time, the flexible nature of the base avoids the breaking of the base during use.

The design of the preferred embodiment is particularly adapted to mass production techniques. Advantageously, hundreds, or even thousands, of male portions of snaps can be attached to strips of material prior to the strips being cut into individual rectangular bases 25, thus greatly facilitating manufacture. Likewise, as discussed above, the heat cutting of the strips results in continuous melted edges 71 which resist fraying.

Another important aspect of the invention is the permanent attachment of the second fastener to the article. Specifically, in the case of a sock, the permanent attachment of the female portion of the snap to the sock makes it easy for a child to dress themselves, as there is no need to realign the position of the bow on the sock, and there is no damage to the sock from repeatedly locking and unlocking the snap. Importantly, the snap has no sharp edges, such as a pin, and is easy for even a small child to manipulate, in contrast to buttons. Furthermore, the snap is desirable in that it will not attach itself to other pieces of clothing during the wash cycle and is inexpensive.

Figure 5:
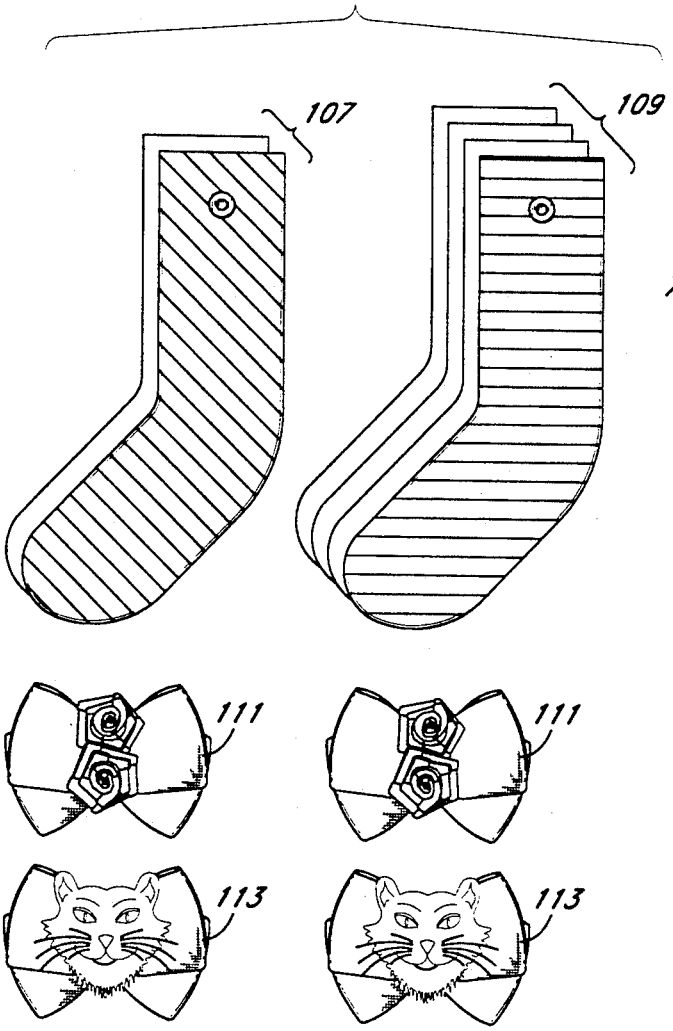
FIG. 5 is a perspective view illustrating different types of socks and bows.

Referring to FIG. 5, yet another aspect of the invention is the ability of a child to use a single decoration 111 on a number of different pairs of socks 107 and 109, thus permitting the single decoration to be worn with different colors and styles of socks. Likewise, the system enables the cost of the socks to be kept down by purchasing only a few decorations to go with many different pairs of socks, whether they are the same color, to permit the respective pairs to be washed, or of multiple colors, to produce a different visual appearance, to go with or create a different outfit. Advantageously, the attachment and reattachment does not hurt the sock, as the female fastener is inserted through the threads of the sock only once. It has been found that even with repeated snapping and unsnapping of the sock from the decoration, the foot portion of the sock will ordinarily wear out before the leg portion of the sock surrounding the female portion of the snap. Regardless, even in the event that the portion of the sock surrounding the snap wears out first, the replacement of the sock bearing the female snap is significantly less expensive than replacing the sock with the decoration. Alternatively, a plurality of decorations, 111 and 113, could be used with a single pair of socks 107.

It will be apparent to those skilled in the art that some modification of the disclosed embodiment may be possible, without departing from the spirit of the invention.

Therefore, the foregoing description is considered to be exemplary, and the true scope of the invention is that defined in the following claims.

We claim:

1. A detachable decoration system, comprising:

an article to be decorated, said article comprising fabric and defining a outer surface and a inner surface;

a first portion of a snap fastener extending through and permanently connected to said article;

a decoration, comprising:

a decorative bow having a center of gravity, a front face, a back face, a central intersecting portion, a first wing portion extending to a side of said central portion and a second wing portion extending to an opposing side of said central portion from said first wing portion, said central portion having a top and a bottom; and, an ornament mounted on said front face;

a base defining a facing surface, a connecting surface, an upper portion, a lower portion, a first side portion and a second side portion and comprising strands of fibers woven such that said connecting surface of said base is uneven, said base being larger than the second portion of said snap fastener in at least one direction;

a second portion of a snap fastener extending through and permanently connected to said base;

said second portion of said snap fastener comprising back and front nipples;

said back nipple including a backing member and a central axially extending inner protuberance, said inner protuberance extending through said base between said strand of fibers such that said backing member is positioned against said connecting surface of said base;

said front nipple including a front member and a central axially extending outer protuberance, said outer protuberance defining an internal cavity, said inner protuberance of said back nipple being tightly secured within said internal cavity so as to permanently affix said front member against said facing surface of said base and said backing member against said connecting surface of said base, and a layer of adhesive between said connecting surface of said base and said back face of said bow, said layer of adhesive securing said base to said decoration such that said upper portion of said base extends substantially to said top of said central portion, said lower portion of said base extends substantially to said bottom of said central portion said first side portion extends along said first wing portion and said second side portion extends along said second wing portion, so that said base and said adhesive provide structural support for said decoration, and said decoration covers said base, wherein said first portion of a snap fastener can be releasably locked with with said outer protuberance of said front nipple said second portion of a snap fastener extending from said facing surface of said base, so that said back face of said bow is facing said outer surface of said article and said front face of said bow is facing away from said outer surface of said article, and wherein, when said first portion of a snap fastener and said second portion of a snap fastener are unlocked, said decoration is wholly disconnected from said article.

2. A detachable decoration system, comprising:

an article to be decorated, said article comprising fabric and defining a outer surface and a inner surface;

a first portion of a snap fastener extending through and permanently connected to said article;

a decoration having a center of gravity, a front face and a back face;

a second portion of a snap fastener;

said second portion of said snap fastener comprising front and back nipples;

said back nipple including a backing member and a central axially extending inner protuberance, said inner protuberance extending through said base between said strands of fibers such that said backing member is positioned against said connecting surface of said base;

a front nipple including said front member and a central axially extending outer protuberance, said outer protuberance defining an internal cavity, said inner protuberance of said back nipple being tightly secured within said internal cavity so as to permanently affix said front member against said facing surface of said base and said backing member against said connecting surface of said base; and a layer of adhesive between said uneven connecting surface of said base and said back face of said decoration, said uneven surface providing increased surface area for adhesion, said layer of adhesive securing said base to said decoration such that said decoration covers said base, said front nipple being positioned above said center of gravity of said decoration, wherein said outer protuberance of said front nipple extending from said facing surface of said base can be releasably lockably retained by said first portion of a snap fastener secured to said article, so that said back face of said decoration is facing said outer surface of said article and said front face of said decoration is facing away from said outer surface of said article.

3. A detachable decoration system, comprising:

an article to be decorated, said article comprising fabric and defining a outer surface and a inner surface;

a first portion of a snap fastener comprising backing and receiving elements;

said backing element including a plurality of prongs;

said receiving element defining an opening, said receiving element cooperating with said prongs so as to permanently affix said backing element against said inner surface of said article and said receiving element against said outer surface of said article;

said first portion of a snap fastener extending through and permanently connected to said article;

a decoration having a center of gravity, a front face and a back face;

a second portion of a snap fastener;

said base defining a facing surface and a connecting surface, said base being larger than said second portion of said snap fastener in at least one dimension, said base comprising strands of fibers woven such that said inner surface of said base is uneven;

said second portion of said snap fastener comprising front and back nipples said back nipple including an backing member and a central axially extending inner protuberance, said inner protuberance extending through said base between said strands of fibers such that said backing member is positioned against said connecting surface of said base, said base being larger than said back nipple in at least one dimension;

a front nipple including a front member and a central axially extending outer protuberance, said outer protuberance defining an internal cavity, said inner protuberance of said back nipple being tightly secured within said internal cavity so as to permanently affix said front member against said facing surface of said base and said connecting member against said connecting surface of said base;

a layer of adhesive between said uneven connecting surface of said base and said back face of said decoration bow, said uneven surface providing increased surface area for adhesion, said layer of adhesive securing said base to said decoration, said front nipple being positioned above said center of gravity of said decoration, wherein said outer protuberance of said front nipple extending from said facing surface of said base can be releasably lockably retained within said opening of said receiving element secured to said article, so that said back face of said decoration is facing said outer surface of said article and said front face of said decoration is facing away from said outer surface of said article and conceals said base from view and, wherein, when said front nipple and said receiving element are unlocked, said decoration is wholly disconnected from said article.

* * * * *